US005623875A

United States Patent [19]

Perets

[11] Patent Number: 5,623,875

[45] Date of Patent: Apr. 29, 1997

[54] MULTI-COLOR AND EASY TO ASSEMBLE AUTOMATIC RUBBER STAMP

[76] Inventor: Mishel Perets, c/o M. Perets Ltd., 15 E. 40th St., 5th Fl., New York, N.Y. 10016

[21] Appl. No.: 623,640

[22] Filed: Mar. 28, 1996

[51] Int. Cl.[6] ..... B41K 1/42

[52] U.S. Cl. ..... 101/334; 101/104

[58] Field of Search ..... 101/104, 105, 101/333, 334

[56] References Cited

U.S. PATENT DOCUMENTS

| | | | |
|---|---|---|---|
| 2,386,965 | 10/1945 | Lui | 101/108 |
| 4,432,281 | 2/1984 | Wall et al. | 101/334 |
| 4,852,489 | 8/1989 | Wall et al. | 101/334 |
| 4,970,954 | 11/1990 | Weir et al. | 101/334 |
| 5,152,223 | 10/1992 | Mairon | 101/334 |
| 5,505,130 | 4/1996 | Winston | 101/333 |

*Primary Examiner*—Ren Yan
*Attorney, Agent, or Firm*—Ostrolenk, Faber, Gerb & Soffen, LLP

[57] ABSTRACT

The invention is directed to an automatic stamping device which includes a hand actuator which is interassembled and slides relative to a housing in which is incorporated a customized stamp. The housing contains window through which an ink pad can be slid into an ink pad holding compartment. When the hand actuator is pressed down, a stamp impression is created on a piece of paper. The ink pad is divided into several sections or compartments, each of which is impregnated with a differently colored ink. The various ink bodies are separated by a wall which is impervious and which prevents ink from diffusing from body to body. Therefore, different portions of the stamp will contact different ones of the bodies and produce differently colored impressions. The customized stamp is formed on a body which can be snap fitted and secured to a pin which extends transversely through the housing. Thus, different stamps can be easily inserted into the same housing or, at least, the stamps can be easily replaced when they require replacement.

8 Claims, 3 Drawing Sheets

MULTI-COLOR AND EASY TO ASSEMBLE AUTOMATIC RUBBER STAMP

BACKGROUND OF THE INVENTION

The present invention relates to automatic rubber stamps of the type comprising a housing and incorporating therein an ink pad compartment, so that a separate ink pad is not required. More specifically, the invention relates to an automatic rubber stamp of the type noted above which provides a multi-colored ink pad and which is made of more easily assembled parts.

Automatic rubber stamps of the type to which the present invention relates are well-known in the art. They contain a housing and an internally-incorporated and replaceable, ink pad. A spring-loaded hand actuated member, slidably mounted on the housing, moves an internally mounted rubber stamp support plate up and down in the housing, in a manner which pivots the support plate to contact the ink pad in one position and to face an opening in the housing adjacent a paper to be stamped in another position. As noted, these automatic, self-inking rubber stamp devices are well-known in the art. One of the distinct disadvantages of the known devices is that they contain a pin which passes laterally through the housing and which supports the rubber stamp support plate. During assembly, the pin must be carefully aligned with the rubber stamp support plate and small holes in the housing, which slows the assembly process. Moreover, all known automatic, self-inking rubber stamp devices provide a single color ink pad, which allows only single color printing.

An example of a prior art automatic rubber stamp is disclosed in the U.S. Pat. No. 5,152,223, the contents of which is incorporated by reference herein.

SUMMARY OF THE INVENTION

Accordingly, it is an object of the present invention to provide an automatic self-inking stamping device which can produce a stamp impression in two or more colors.

It is another object of the invention to provide a self-inking automatic stamping device which is simple to assemble and use.

It is yet another object of the present invention to provide an automatic stamping device which is highly reliable.

The foregoing and other aspects of the present invention are realized with the novel automatic stamping device of the present invention which include a hand actuator which is interassembled and slides relative to a housing in which is incorporated a customized stamp and which contains a window through which an ink pad can be slid into an ink pad holding compartment. When the hand actuator is pressed down a stamp impression is created on a piece of paper, in well known manner.

The ink pad of the present invention comprises a tray which holds an ink impregnated body. In accordance with the present invention, the body is divided into several sections, each impregnated with a differently colored ink. The various bodies are separated by a wall which is impervious and which prevents ink from diffusing from body to body. Therefore, different portions of the stamp will contact different ones of the bodies and produce differently colored impressions.

In accordance with another aspect of the invention, the pin which passes through the stamp is inserted first into the housing and the stamp has an open, channel slot which can be snap pressed onto the pin. This considerably facilitates assembly of the stamp.

Other features and advantages of the present invention will become apparent from the following description of the invention which refers to the accompanying drawings.

DETAILED DESCRIPTION OF THE INVENTION

Figure 1:
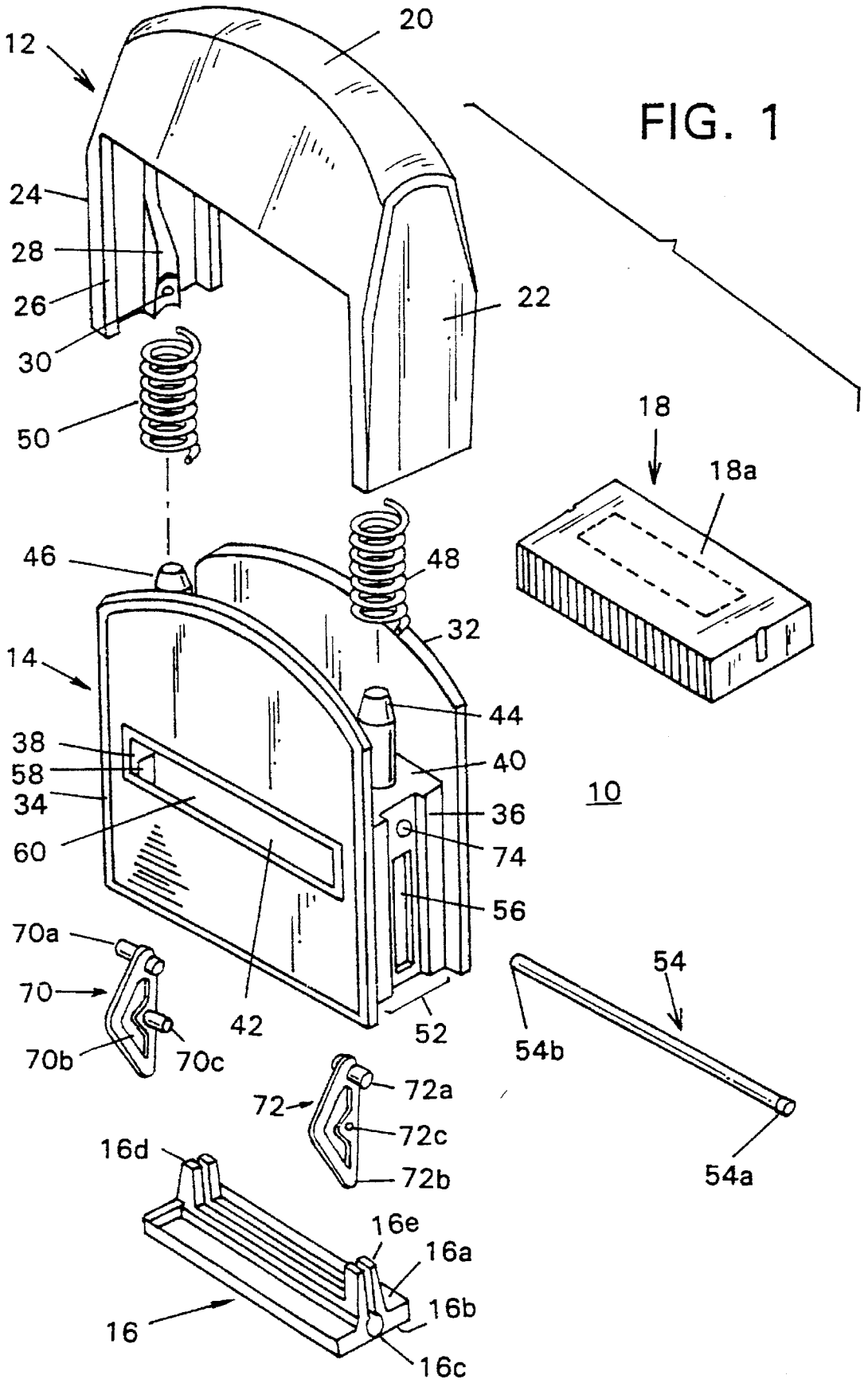
FIG. 1 is an exploded view of the invention.

With reference to the figures, FIG. 1 is an exploded view of the self-inking stamping device 10 whose essential constituents are a hand actuator 12, a housing 14, a customized stamp 16 and an ink pad 18.

Figure 3:
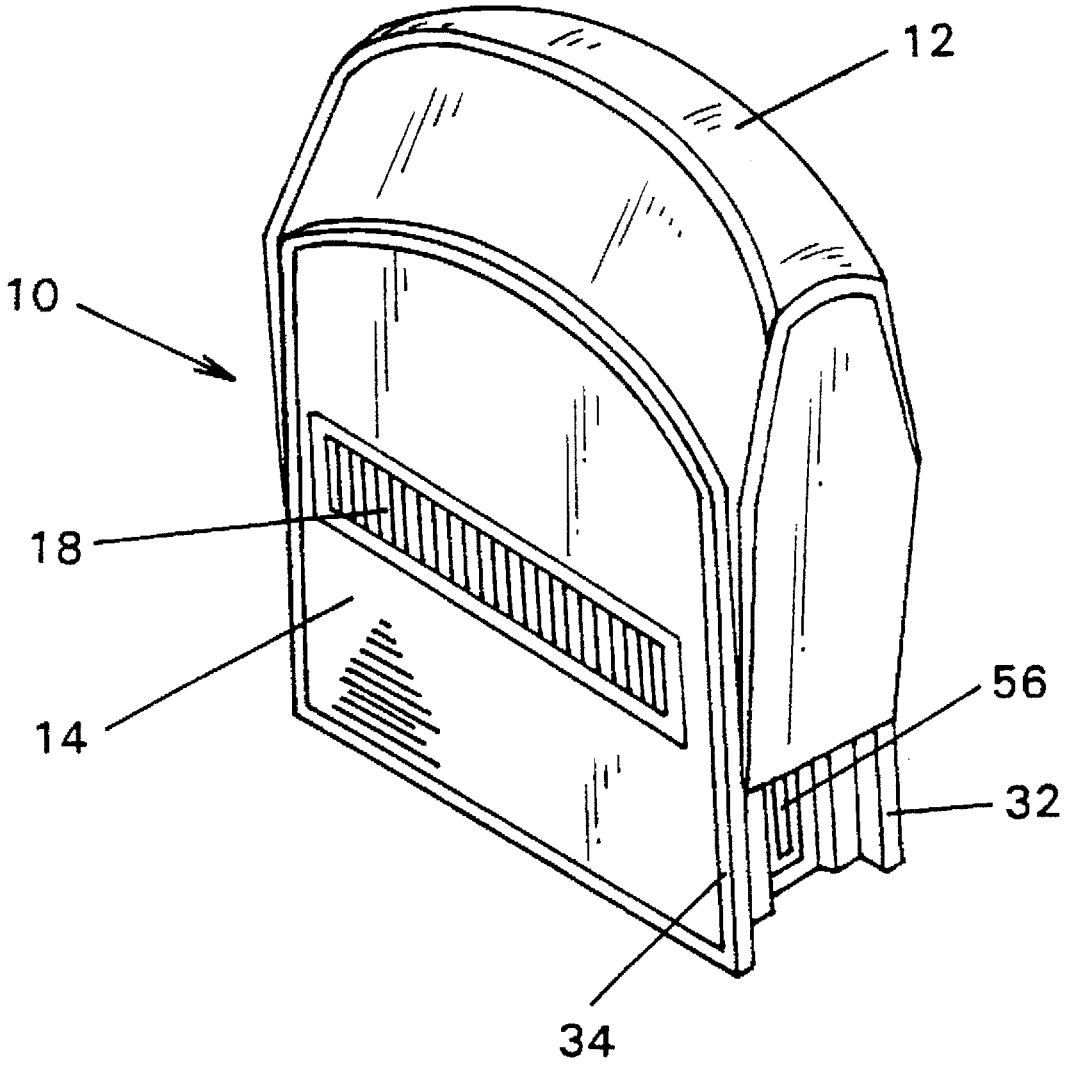
FIG. 3 shows the automatic stamping device of the present invention, fully assembled.

In the assembled form of the self-inking automated stamp 10 shown in FIG. 3, the hand actuator 12 is interassembled with the housing 14, which housing is disposed over a piece of paper (not shown) so that when the hand actuator 12 is pressed down a stamp impression is created on the piece of paper, in well known manner.

The hand actuator 12 has an arch shape head 20 and a pair of guiding arm 22 and 24 with laterally and inwardly extending arm projections 26. The arms 22 and 24 serve as guiding arms which slide in channels (to be described) of the housing 14. Extending longitudinally, centrally and along the interior of the guiding arms 22 and 24 is a projection 28 at the end of which there is defined a small pin catch hole 30.

The housing 14 is constituted of a rear wall 32, a front wall 34, side walls 36 and 38 and an ink pad support 40. The above elements cooperate to define a chamber 42 in which the ink pad 18 and the stamp 16 are located in a manner to be described.

Located between the extensions of the walls 32 and 34 above the ink pad rest 40 are a pair of spaced spring holding fingers 44 and 46, each of which centers and supports a respective spring 48 and 50.

As shown in FIG. 3, the hand actuator 12 is designed to slide between the walls 32 and 34 of the housing 14, in left and right actuator sliding channels 52 which are defined by the extensions of the walls 32 and 34 beyond thee side walls 36 and 38 as shown. The width of the guiding arms 22 and 24 matches the width of the aforementioned guiding channels 52. The pin 54 extends sideways through the chamber 42, its distal ends 54*a* and 54*b* protruding somewhat beyond the left and right stamp guide channels 56 and 58 of the housing 14. In the assembled form, the distal ends 54*a* and 54*b* of the pin 54 are snagged and held inside the left and right pin catches 30 of the hand actuator 12.

Aligned windows 60 in the front and rear walls 34 and 32 of the housing 14 define a ink pad insertion opening for the ink pad 18, which ink pad is designed to slide into the housing 14 through either the front window 60 or the rear window (not shown) with the ink face 18*a* thereof facing downward, toward the bottom, open side of the housing 14.

In well known manner, the stamp 16 comprises a base 16*a* which has bottom side 16*b* on which are arranged stamping letters, logos or the like (not shown). The stamp 16 defines in its base a semi-cylindrical pin snap channel 16*c* which is sized to be just slightly narrower than the diameter of the pin 54. When the stamp 16 is guided into the chamber 42, the aligning projections 16*d* and 16*e* allow the stamp 16 to be guided toward the pin 54 and the two elements to snap interconnect with one another, without, the need for careful, visual alignment of the same.

In well known manner, the stamp 16 is designed to rest inside the chamber 42 with its stamping face 16*b* resting solidly against the inking face 18*a* of the ink pad 18. When the hand actuator 12 is pressed down against the springs 48 and 50, the stamp 16 is pushed down and at the same time is flipped 180° so that the stamp face 16*b* faces down. In this manner, when the hand actuator 20 has been pressed down all the way, an ink impression is produced on a paper, in well known manner.

The flipping mechanism for the stamp 16 includes a left flipper 70 and a right flipper 72. The snap pin 72*a* of the right flipper 72 (and the corresponding snap pin 70*a* of the other flipper 70) fit inside the chamber 42 and are held in place through a snap fit connection of the snap ends 72*a* and 70*a* in the flipper catch hole 74 that is defined in the side walls 36 and 38 of the housing 14. The distal ends of the pin 54 slide along both the stamp guide channels 56 and 58 of the housing 14 and along the channels 70*b* and 72*b* of the flippers 70 and 72. Each of flippers 70 and 72 has its respective stamp, flipper pin 70*c* and 72*c* which are disposed between each pair of projections 16*d* and 16*e* of the stamp 16. These parts operate so that when the stamp 16 is pressed down the off center location of the flipping pins 70*c* and 72*c* cause the stamp to face upwards or downwards, as described above.

With the design of the present invention, assembly of the device allows the pin 54 to be assembled first, without having to thread the same through the stamp 16 as in the prior art. Instead, as a last step, the stamp 16 needs to be pressed into the chamber 42 from the bottom opening of the housing with the guiding projections 16*d* and 16*e* facing the pin 54, and then just snap pressed against it. That is all that is required for completing the assembly.

Figure 2A:
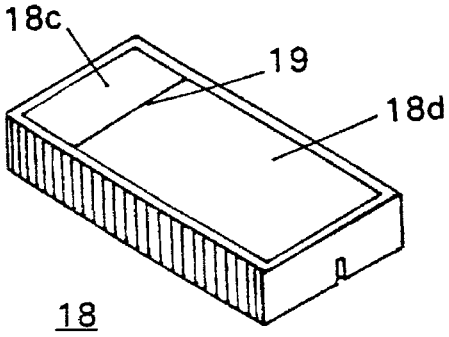
FIGS. 2*a*–2*f* show various styles of ink pads which can be used with the present invention.
Figure 2B:
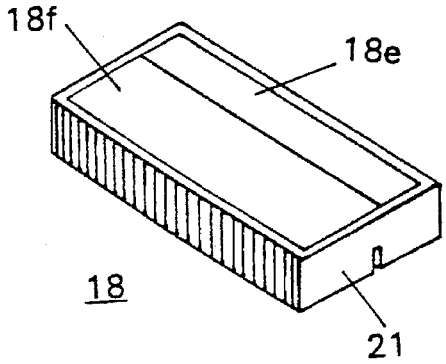
Figure 2C:
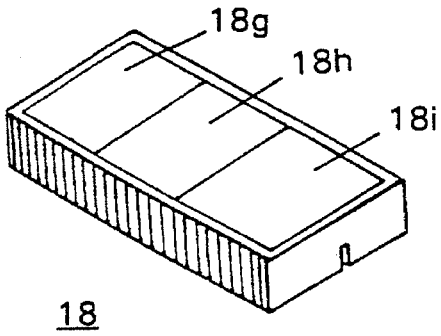
Figure 2D:
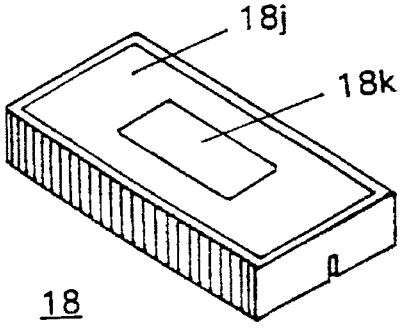
Figure 2E:
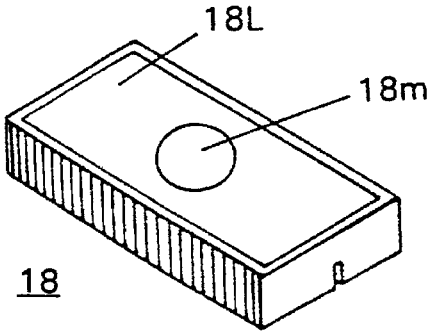
Figure 2F:
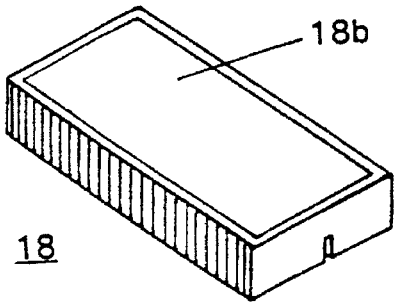
FIG. 2f PRIOR ART

Referring now to. FIGS. 2*a*–2*f*, FIG. 2*f* shows a prior art ink pad in which the ink face 18*a* comprises an ink impregnated single body 18*b*. Since the ink is distributed throughout the body, only single color printing is possible. In contrast to this unitarily constructed ink body 18*b* of FIG. 2*f*, FIG. 2*a* shows two separate bodies 18*c* and 18*d*, each of a different color and separated by an impervious wall 19. In FIG. 2*b*, the ink pads 18*e* and 18*f* divide the interior space of the tray 21 which holds the pads in another configuration, as shown. In FIG. 2*c*, three ink pads 18*g*, 18*h* and 18*i* are provided. In the embodiment of FIG. 2*d*, the ink pad 18*j* surrounds the rectangularly shaped centrally located ink pad 18*k*. In all of the embodiments, two or more ink colors are used. Finally, FIG. 2*e* shows a round ink pad 18*m* which is surrounded by an ink pad 181. In all cases, between the ink pads there is provided a dividing wall which is impenetrable and impervious to ink, and which assures that ink will not diffuse or blot therethrough.

Therefore, with the present invention, the automatic, self-inking stamp can be easily assembled as noted above, and can also produce ink impressions of various colors. For example, in the embodiment of FIG. 2*e* the center pad can be colored red and show a design while the surrounding ink pad can carry letter or number characters. Of course the same and any type of arrangement can be provided with the ink pads shown in the other figures. Also note that any shape or configuration is possible to suit the particular desires of the ultimate users of the stamp.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An automatic, self-inking stamping device, comprising:

a housing defining an inner chamber and having a pair of side channels;

a stamping element having a base and being reciprocally movable in the chamber of the housing;

a pin extending transversely through the chamber of the housing and having distal ends which protrude from the pair of side channels in the housing;

a hand actuator coupled with and slidable relative to the housing, the pin being secured to and movable with the hand actuator, the stamping element being also secured to and movable with the pin, the stamping element having a stamping face carrying a printing impression;

an ink pad disposed in the chamber, at a location spatially between the stamping element and the hand actuator;

a flipping mechanism for flipping the stamping element in the chamber in response to actuation of the hand actuator, so that when the hand actuator is in a rest position the stamping face lies against and contacts the ink pad and when the hand actuator is in a depressed position, the stamping face is flipped to face away from the ink pad;

the ink pad comprising a plurality of pad sections providing at least two differently colored ink pads; and in which the pin and the stamping element are secured to one another by a snap connection which permits separation of the stamping element from the pin by pulling the stamping element away from the pin, the snap connection comprising a semi-cylindrical channel formed in the base of the stamping element for receiving and removably holding the pin therein.

2. The stamping device of claim 1, the hand actuator including guiding arms and in which the housing defines sliding channels for the guiding arms of the hand actuator.

3. The stamping device of claim 1, in which the housing defines at least one window in the housing through which the ink pad can be slid into the chamber.

4. The stamping device of claim 3, including at least one spring disposed between the housing and the hand actuator to bias the hand actuator away from the housing.

5. The stamping device of claim 4, in which the ink pad comprises a substantially rectangular tray divided into a plurality of compartments each holding a body impregnated with its own respective ink.

6. The stamping device of claim 1, including a first flipping element disposed adjacent a first one of the pair of side channels in the housing and a second flipping element disposed adjacent the other one of said pair of side channels in the housing.

7. The stamping device of claim 6, in which the stamping element has a base including guiding elements projecting oppositely to the stamping face of the stamping element.

8. The stamping device of claim 7, in which the guiding elements interact with the flipping elements to flip the stamping element as it reciprocates inside the chamber.

* * * * *